US006575107B1

(12) United States Patent
Fernandez Puentes

(10) Patent No.: US 6,575,107 B1
(45) Date of Patent: Jun. 10, 2003

(54) ROTARY GEAR FOR SAILING BOATS

(75) Inventor: Gonzalo Fernandez Puentes, Madrid (ES)

(73) Assignee: Inversail, S.A., Madrid (ES)

( * ) Notice: Subject to any disclaimer, the term of this patent is extended or adjusted under 35 U.S.C. 154(b) by 0 days.

(21) Appl. No.: 10/019,302

(22) PCT Filed: Jul. 4, 2000

(86) PCT No.: PCT/ES00/00235

§ 371 (c)(1),
(2), (4) Date: Mar. 13, 2002

(87) PCT Pub. No.: WO01/04000

PCT Pub. Date: Jan. 18, 2001

(30) Foreign Application Priority Data

Jul. 13, 1999 (ES) ..... 9901563

(51) Int. Cl.[7] ..... B63H 9/04
(52) U.S. Cl. ..... 114/91; 114/39.29; 114/102.16
(58) Field of Search ..... 114/39.29, 90, 114/91, 98, 102.17, 102.18, 102.19, 102.2, 102.21, 102.29, 102.16

(56) References Cited

U.S. PATENT DOCUMENTS 3,205,849 A * 9/1965 Thorndike ..... 114/39.29
3,656,444 A * 4/1972 Kratz ..... 114/102.16
4,230,060 A * 10/1980 McCoy ..... 114/102.29
4,314,518 A * 2/1982 Marsden ..... 114/144 C

FOREIGN PATENT DOCUMENTS

WO WO 89/02847 * 4/1989 ..... 114/90

* cited by examiner

*Primary Examiner*—Sherman Basinger
(74) *Attorney, Agent, or Firm*—Dennison, Schultz & Dougherty

(57) ABSTRACT

An improved rotary gear for sailing boats is provided wherein the connection of the boom to the rest of the rig is such that on the horizontal plane the boom must rotate simultaneously with the rest of the rig, but that it can move up and down in the vertical plane in order to give tension to the sails and wherein the axis widens as it comes through the deck creating a base wide and strong, making it possible to control the rotation of the whole rig from the base, not only because of the necessary rotation control mechanisms, but also because the remaining rig elements are forced to rotate with the base, which permits also the use of rotating shrouds and stays to help in supporting the mast.

3 Claims, 4 Drawing Sheets

ROTARY GEAR FOR SAILING BOATS

BACKGROUND OF INVENTION

The swinging rigs have been known for several years. They were first used in model boats. To our knowledge the first person to use them in crewed boats, was K. R. May in 1975 with his "Boomsprit". (Published by AYRS in their N°. 81). Later swinging rigs have been offered commercially for crewed boats, the most outstanding being the "Aerorig" developed by Ian Howlet and Carbospars Ltd, United Kingdom, in 1990 (European patent application n° EP 0 392 848 A1).

We think that these rigs, and specially the Aerorig the most successful, have some important drawbacks. The windward efficiency of these rigs is poor, due we believe to the lack of the jib luff tension, to the great thickness of the mast, to the flexibility of the top of a mast without shrouds, and to the lack of roach on the main sail.

Also, the union of the boom-yard to the mast is a bad engineering solution as it forces the great tensions of the main sail and the jib to be absorbed by a rigid punctual junction. This rigid junction also makes assembly and disassembly mote difficult, prevents the variation of the distance between boom and deck, and prevents the tensioning of the sails downwards. Being the rig compensated, and being controlled only the main sail sheet, its rotational stability is bad, being difficult to steady the rig with feeble winds, forcing reefing to be made simultaneously in both sails, and making the addition of more sail area difficult.

SUMMARY OF THE INVENTION

An improved rotary gear for sailing boats is provided wherein the connection of the boom to the rest of the rig is such that on the horizontal plane the boom must rotate simultaneously with the rest of the rig, but that it can move up and down in the vertical plane in order to give tension to the sails and wherein the axis widens as it comes through the deck creating a base wide and strong, making it possible to control the rotation of the whole rig from the base, not only because of the necessary rotation control mechanisms, but also because the remaining rig elements are forced to rotate with the base, which permits also the use of rotating shrouds and stays to help in supporting the mast.

DESCRIPTION OF THE PREFERRED EMBODIMENT

Figure 1:
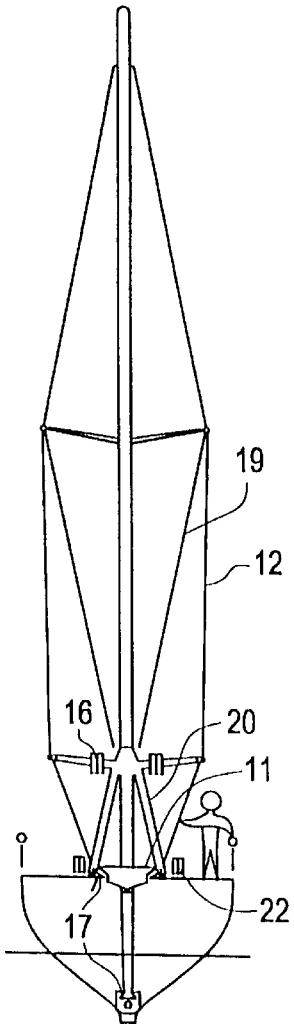
FIG. 1 shows a frontal elevation of the invention rig, sectioned at axis level.

The present invention represents an important improvement on the existing "swinging rig" for sailing boats. The name swinging rig is usually applied to a sloop marconi type of rig where the mast perforates the deck and goes down to the keel, and supports the rest of the rig basically without stays or shrouds, while the whole rig rotates simultaneously 360° around itself. In order to avoid excessively big horizontal rotating torques, this rig has sailing areas at both sides of the rotating axis in such a way that the reaction center lies behind and not very far away from the above mentioned axis of rotation. This is achieved by having a main sail 1 behind the mast 3 and a jib 5 bent onto a rigid prolongation of the boom 2 in front of the mast 3, which we shall call yard 4.

This type of rig has the advantages of permitting the control of the two sails with a single sheet, of reducing the great upward forces in the sail sheets, as they are connected to the rotating mast, of having a small horizontal rotating torque, of maintaining a constant slot 9 between the jib 5 and the main sail 1, of eliminating the main sail banqueting the jib in down wind courses, of being able to receive the wind always from the luff 8, of avoiding dangerous gybings, and of permitting safe weather-cocking with sudden gusts of wind.

Figure 4:
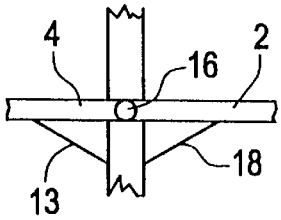

The shortcomings of the prior art are also addressed by having the boom-yard assembly not being joined rigidly to the mast 3, but through a hinged junction 16, and boom 2 and yard 4 each connected by tensors or sheets 18 to the bottom of the mast 3. This would make assembly easier, allow for a lighter boom-yard, with up and down movement, and a better control of the sails tension (FIG. 4).

Figure 5:
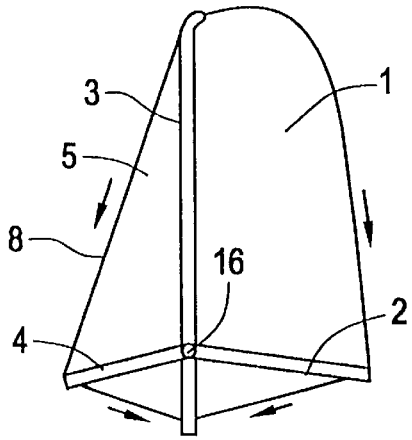
FIGS. 4–8 show the logical evolution described in the specification.

It would be an even better solution to make independent boom and yard (FIG. 5). This would permit not only to give tension independently to jib and main, but also that more tension on the sheet of the main sail would also create more tension on the luff of the jib through the top of the mast.

Figure 6:
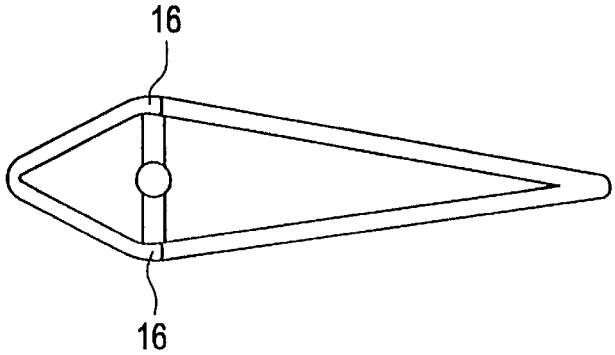

In order to absorb the opposed horizontal torque of the boom 2 and of the yard 4, their hinged junctions 16 to the mast 3 should be strong and wide. A wish-bone type of solution for the boom 2, and also for the yard 4, would easily achieve this, and it would also allow that the sails, specially the main sail slides, come down between the wish-bone boom sides, specially when lowering or reefing (FIG. 6).

Figure 7:
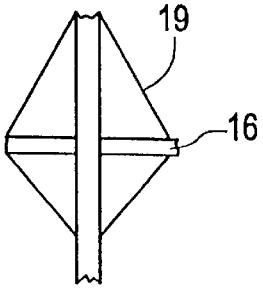
Figure 8:
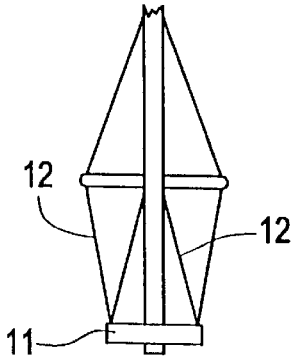

The next step comes almost automatically. If we have a wide junction, why not set diamond shrouds 19? (FIG. 7). The next step is also obvious. The base 11 of the mast 3 at deck level is widened, as best seen in FIG. 8. This base would permit:

1. Helping to stiffen the mast 3 by means of rotating shrouds 12.
2. Avoiding deformations at the deck bearing 17 level, allowing thus an easier rotation.
3. Allowing the main sail 1 sheet and the yard tensor 13 to pull with a better angle.
4. Keeping the mast 3 tensioned backwards, by having backswept shrouds and spreaders, independently of the tension, which the main sail itself could transmit.

Figure 2:
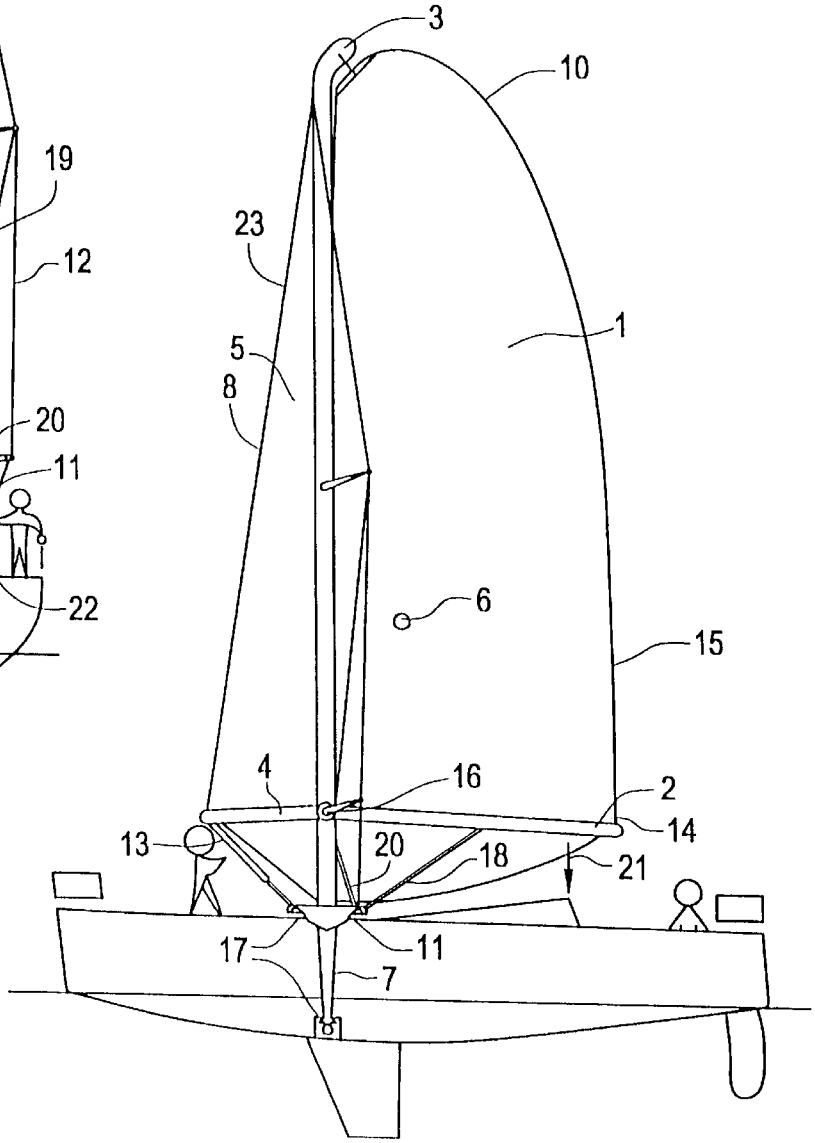
FIG. 2 show a transversal elevation of the sailing boat with the above mentioned rig and with the sails set, sectioned at axis level.

The solutions we have proposed rely mainly on a strong base at the bottom of the rig and on a wider and more sensible structure, which give us a lighter, stronger and cheaper rig. It is really a solution in three dimensions:

1. On the vertical athwarships plane, diamonds 19 and shrouds 12 fixed to the base 11 will help in supporting the mast 3, as best seen in FIG. 1.
2. On the fore-after plane, the tensions on the main sail sheet I will increase the tension of its leech, and indirectly the tension on the jibs luff, as best seen in FIG. 2.

Figure 3:
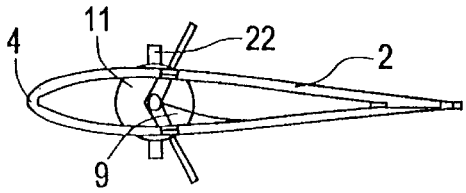
FIG. 3 shows a rig ground plan with the wishbone.

3. On the horizontal plane, we have a sensible wishbone type of solution, as best seen in FIG. 3.

Although for dingy sailing the remaining torque's of horizontal rotation of the rig can easily be absorbed by a main sail external sheet, for bigger boats we must go to what we could call the "fourth dimension". If we connect the boom-yard assembly to the base, directly or through strong enough intermediate connecting structures 20, and surround the base 11 with the necessary rotation control mechanism 22, we can control the rotation or non-rotation of the sailing rig, even without the need of an external sheet. We would then have something like a permanent preventer, something like a prisoner or tamed rig.

A sophisticated control of the rotation of the rig could include:

1. Braking the rotation.
2. Slowing down the rotation.
3. Limitation of the angles of rotation, especially in windward sailing.
4. Possibility of rotation in only direction.
5. Safety rotation for sudden wind blasts.
6. And even remote rotation control, either manual or mechanical. Actually controlling the rotation of the rig from the base, instead of doing it with the main sail sheet, it is more complicated than it seems. If the control is done with the main sail sheet, it is only necessary to rigidize the horizontal junction between yard and boom, as the main sail rotation is already controlled by its sheet. But if contrarily we want to do the control of the rotation from the base, we must also rigidize the horizontal junction between the boom and the base, and we must have a very strong connection capable of absorbing the enormous torque produced by the main sail, and in such a way that the boom as it rotates does not "chop off" the heads of the crew, and that the tensions on the main sail and on the jibs luff can be controlled.

Having a strong rig with its rotation well controlled permits the use of temporary additional sails with feeble winds. That is, not only about rotating sails such as bigger jibs or about additional polled out jibs, but also about fixed jibs bent down to the deck and bent above to the mast of the rotating rig. It would be something like a first reef.

Figure 9:
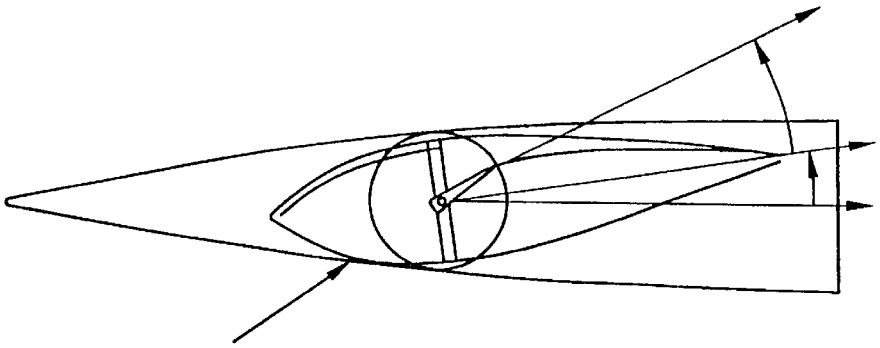
FIGS. 9–13 show several ways of getting good wingmasts with the rig.

A wing-mast could be easily installed with this type of rig. It would increase windward performance. Naturally this would mean a second rotation of the wing-mast in relation to the boom-yard axis (FIG. 9).

Figure 10:
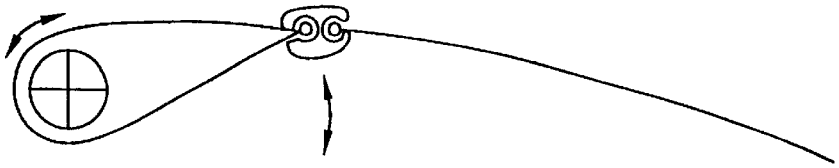
Figure 11:
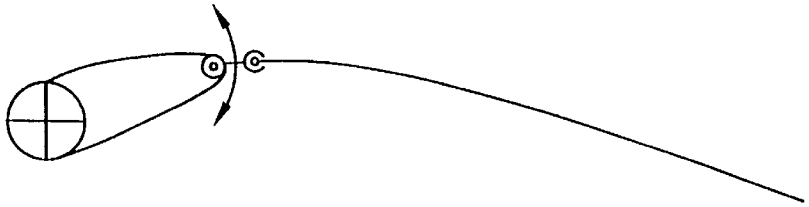
Figure 12:
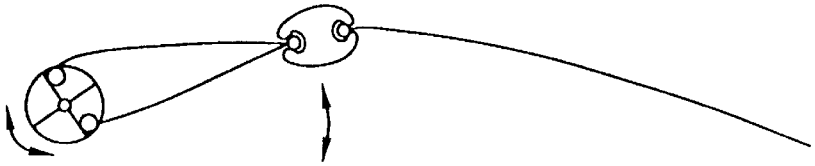
Figure 13:
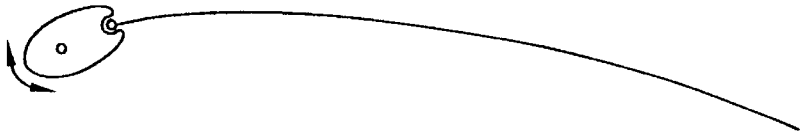

But a wing-mast is like a sail permanently hoisted, with all the drawbacks that this implies. Alternative solutions could be: A fixed mast shrouded with canvas (FIG. 10), or a fixed mast with two rails, a piece of canvas to simulate a wing, and a vertical autorotating bar bent to the proper sail (FIG. 11), or a rotating round mast, also with two rails and a piece of canvas to simulate the wing-sail, and a fixed connection to the proper sail (FIG. 12), or finally a rotating mast with an oblong section and with the sail directly bent to it (FIG. 13).

In solutions (FIG. 13, FIG. 11 and FIG. 12), the wing-mast canvas could be retrieved: either by lowering it down along its rails on to the deck, or by rolling them around the mast or around the luff of the proper sail.

The mast does not have to coincide with the axis of rotation. The forward inclination of the mast, in relation to the axis, helps to compensate the rig. Having a wide base, and a good rotation control mechanism, imply less need for compensation.

Having a wide and strong base 11, and strong intermediate connecting structures 20, mean that it will not be necessary for the mast and the base to be of a single piece, being possible for the mast to down to the keel and supported by bearings 17, through the base, or simply rest on the base.

Although this rig has been conceived as a self-supporting one, in some extreme cases it could be of interest the use of permanent external staying. One of these cases could be a wide multihull with four stays one on each corner. Several jibs as well as two parallel main sails could be used. A boat can have more than one spindle rig and mixed with fixed rigs. Hilliards, reefing lines, and other ropes could be passed through the base and controlled from inside the boat.

The jib could be rigid. Something like the slot aileron on the forward part of an aeroplane wing, but symmetric off course. It could even merge with a wing-mast. We would then have something similar to the rig of a windsurfers boat. In this case a mini-wishbone should be used to separate the mast and the boom. Instead of a hinged boom, a downwards flexible boom could be used. The tensioning of the main sail could lie also done from the jib stay and through the top of the mast.

Even a double mast, a telescopic mast, lateral jib stays, two small sails placed side by side of the mast to enhance the slot effect of a selftending jib, etc.

A Spindle Rig, or Spindle Sail, can be advantageously used by almost any type of sailing vessel, whether monohull or multihull. For example a 10 m. L.O.A. monohull with a single rig as in (FIG. 1) to (FIG. 3); or a 40 to 50 KGs. demountable trimaran, for the car roof rack, with a single sail; or a 200 kgs. trailerable trimaran, with floats that can be slided close to the mainhull, with a single Spindle Rig; or a 16 in. monohull, with two Spindle Rigs and the possibility of a temporary fixed jib for feeble winds; etc.

Figure 14:
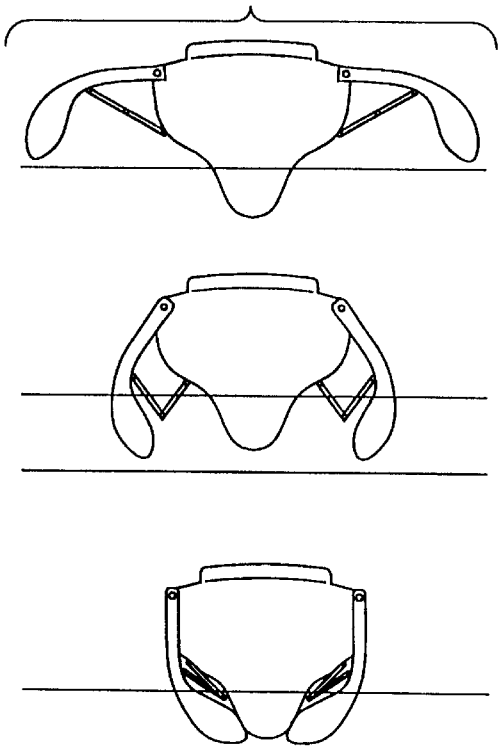
FIGS. 14–16 show schematically an approx. 10 m. L.O.A. trimaran, with folding floats for docking and transport, also with a spindle rig.
Figure 15:
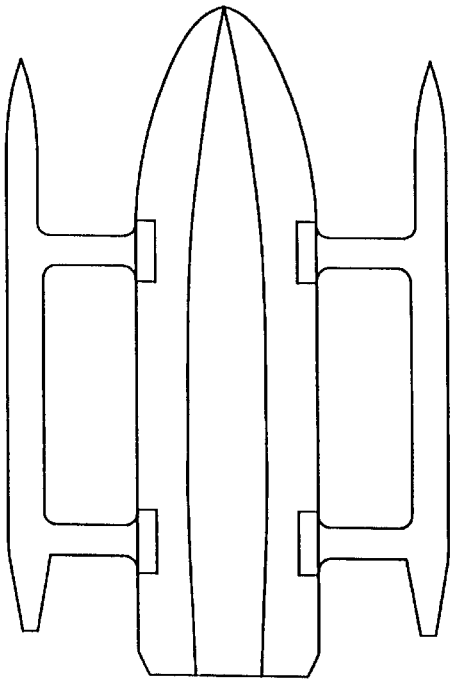
Figure 16:
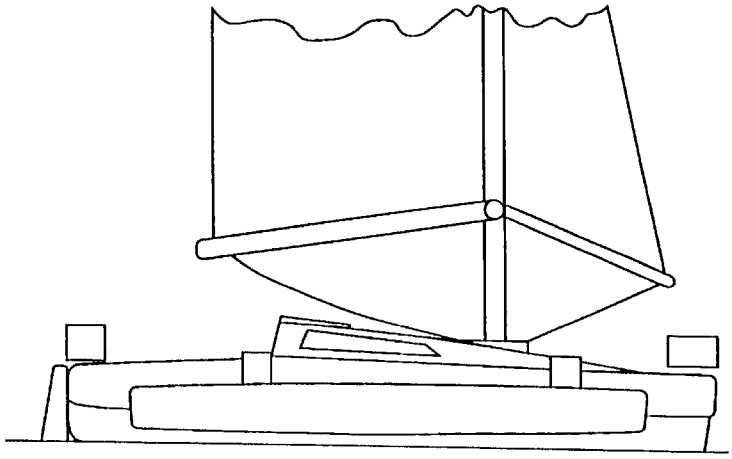

But our pet project is a motorsailing trimaran of about 10 m. L.O.A., with inward and downward foldable floats, for docking and transport, hinged to the main-hull (FIG. 14) to (FIG. 16). As a special additional characteristic, it should have floats capable of moving in such a way that their floating line can be non parallel to the floating line of the mainhull. This could be done through material flexibility of the connecting arms, or through hinged connections.

What is claimed is:

1. A swinging rig for a sailing boat, comprising:

a mast defined by a vertical axis passing through a deck of the sailing boat to a keel, supported by a wide base adjacent the deck and rotatably supported by bearings, said mast also supported by a second bearing being adjacent the keel, capable of rotating 360° around itself, and capable of supporting the rig which it rotates simultaneously, a boom, a main sail bent to the mast and to the boom, a yard prolongation of the boom in front of the mast, and a jib bent to the mast and to the yard, wherein said yard and said boom are connected to said wide base by a plurality of intermediate connecting structures, said boom being connected to the rig by means comprising a hinged junction around a horizontal axis such that in a horizontal plane the boom must rotate simultaneously with the rest of the rig and is movable up and down, the means further comprising a flexible or rigid main sail sheet connected to the rest of the rig which can push or pull.

2. The rig of claim 1, further comprising a rotation control means having a simple braking or automated telecontrol.

3. The rig of claim 1, wherein the base includes a rotating shroud and stays to support the mast.

* * * * *